US011541263B2

(12) United States Patent
Solovev et al.

(10) Patent No.: US 11,541,263 B2
(45) Date of Patent: Jan. 3, 2023

(54) NITROGEN-GENERATING COMPOSITION FOR FIRE EXTINGUISHING AND METHOD FOR PRODUCING THE SAME

(71) Applicants: Estikonde Investment Limited, Cyprus (GR); Vladimir Aleksandrovich Solovev, St. Petersburg (RU); Aleksandr Sergeevich Sokolnikov, Moscow (RU)

(72) Inventors: Vladimir Aleksandrovich Solovev, St. Petersburg (RU); Aleksandr Sergeevich Sokolnikov, Moscow (RU)

( * ) Notice: Subject to any disclaimer, the term of this patent is extended or adjusted under 35 U.S.C. 154(b) by 0 days.

(21) Appl. No.: 17/278,278

(22) PCT Filed: May 24, 2019

(86) PCT No.: PCT/RU2019/000368
§ 371 (c)(1),
(2) Date: Mar. 19, 2021

(87) PCT Pub. No.: WO2020/060440
PCT Pub. Date: Mar. 26, 2020

(65) Prior Publication Data

US 2021/0346745 A1 Nov. 11, 2021

(30) Foreign Application Priority Data

Sep. 21, 2018 (RU) ..... RU2018133432

(51) Int. Cl.
*A62D 1/00* (2006.01)
*A62D 1/06* (2006.01)
(Continued)

(52) U.S. Cl.
CPC ..... *A62D 1/06* (2013.01); *A62D 1/0007* (2013.01); *C06B 35/00* (2013.01); *C06D 5/06* (2013.01)

(58) Field of Classification Search
CPC ..... A62D 1/00; A62D 1/0007; A62D 1/0014; A62D 1/0021; A62D 1/06; C06B 31/00;
(Continued)

(56) References Cited

U.S. PATENT DOCUMENTS 3,909,455 A 9/1975 Rainer et al.
4,604,151 A * 8/1986 Knowlton ..... C06D 5/06 280/736
(Continued)

FOREIGN PATENT DOCUMENTS

EP 584899 A2 * 3/1994 ..... C06B 35/00
GB 1429842 A * 3/1976 ..... C06B 35/00
(Continued)

OTHER PUBLICATIONS

Jarup ("Hazards of heavy metal contamination," British Medical Bulletin 2003; 68: 167-182) (Year: 2003).*
(Continued)

*Primary Examiner* — Matthew R Diaz
(74) *Attorney, Agent, or Firm* — Pequignot + Myers; Matthew A. Pequignot

(57) ABSTRACT

The invention relates to nitrogen-generating compositions for saturation fire-extinguishing and to methods for producing same. The composition comprises: 25.0-45.0% by mass of a heavy metal oxide, 12.0-18.0% by mass of a combustion modifier in the form of aluminium oxide modified with cobalt (II) nitrate (Co(NO3)2), with accelerating additives of nickel oxide and copper oxide, with an alkali metal azide making up the remainder to 100% and 0.07-2.0% by mass of a carboxylic acid ester as moistener (residue after drying) above 100%. The composition is produced by mixing aluminium oxide with cobalt nitrate and with the moistener, allowing the mixture to stand and dry out so as to produce a first mixture, separately mixing the first mixture with the
(Continued)

heavy metal oxide and the moistener until a second mixture is produced, separately preparing a mixture of alkali metal azide powder with the moistener until a third mixture is produced and then mixing the second mixture and the third mixture simultaneously with copper oxide and nickel oxide, drying out the produced mass and forming granules.

9 Claims, 1 Drawing Sheet

(51) Int. Cl.
*C06B 35/00* (2006.01)
*C06D 5/06* (2006.01)

(58) Field of Classification Search
CPC .. C06B 35/00; C06D 5/00; C06D 5/06; C01B 21/02
USPC ..... 252/2, 4, 5, 7; 149/35
See application file for complete search history.

(56) References Cited

U.S. PATENT DOCUMENTS 5,143,567 A * 9/1992 Taylor ..... C06B 35/00 149/35
5,462,306 A * 10/1995 Barcaskey ..... C06D 5/06 280/736
5,741,999 A * 4/1998 Kazumi ..... C06D 5/06 149/43
5,780,767 A * 7/1998 Matsuda ..... C06D 5/06 149/36
6,170,869 B1 * 1/2001 Tomiyama ..... B60R 21/2644 280/741
6,406,060 B1 * 6/2002 Katsuda ..... C06D 5/06 280/736
6,854,395 B2 * 2/2005 Katsuda ..... C06D 5/06 149/36
7,993,475 B2 * 8/2011 Serizawa ..... C06D 5/06 149/21
8,460,575 B2 * 6/2013 van Vliet ..... C06D 5/06 252/183.12

FOREIGN PATENT DOCUMENTS

JP H02221179 9/1990
RU 94036677 7/1996
RU 2091106 9/1997
RU 2484075 6/2013
RU 2484075 C2 * 6/2013 ..... C06B 35/00
RU 2648081 3/2018
RU 2648081 C1 * 3/2018

OTHER PUBLICATIONS

English language machine translation of Porokhovnikov et al. (RU 2484075 C2) (Year: 2013).*
English language machine translation of Sokolnikov et al. (RU 2648081 C1) (Year: 2018).*
PCT Search Report for PCT/RU2019/000368 dated Oct. 17, 2019.

* cited by examiner

NITROGEN-GENERATING COMPOSITION FOR FIRE EXTINGUISHING AND METHOD FOR PRODUCING THE SAME

RELATED APPLICATION DATA

This application is the national stage entry of International Appl. No. PCT/RU2019/000368, filed May 24, 2019, which claims priority to Russian Patent Application No. RU2018133432 filed Sep. 21, 2018. All claims of priority to that application are hereby made, and that application is hereby incorporated in its entirety by reference.

FIELD OF THE INVENTION

This invention relates to solid propellant gas generating compositions for saturation fire extinguishing and may be used in devices for suppressing fires at their seats in enclosed or partially enclosed spaces and to prevent combustion and explosion of vaporous and air-suspended highly-inflammable liquids, combustible substances and materials.

PRIOR ART

Gaseous compositions, such as nitrogenous compounds, are widely used in fire extinguishing systems intended for the protection of material and cultural assets, computer centers, telecommunications facilities, museums, archive rooms, and other facilities where the use of conventional extinguishing media (water, foam or powders) may lead to irrecoverable losses. The devices utilizing pyrotechnic nitrogen-generating compositions are mobile, constantly available, and retain their properties for a long time.

Known in the art are nitrogen-generating (nitrogen forming) compositions based on alkali metal and alkaline earth metal azides, as well as compositions based on organic azides, high-nitrogen cyclic compounds, non-azide metal derivatives of tetrazoles, bitetrazoles and triazoles, such as those described, for example, in U.S. Pat. No. 5,035,757 (published 30 Jul. 1991). However, when combusted, most of them produce unacceptably high levels of toxic gases: carbon oxide, nitrogen oxides, ammonia. Furthermore, they are highly explosive and are initiating explosive substances (ES) (Bagal, L. I., *Khimiya i tekhnologiya initsiiruyushchikh vzryvchatykh veshchestv*. Moscow, Mashinostroyeniye, 1975 (*Chemistry and Technology of Initiating Explosive Substances*, Moscow, Mashinostroyeniye, 1975)).

Being incapable of explosive conversion, sodium azide is mainly used in nitrogen-generating compositions. Compositions for fire extinguishing media must meet strict regulatory requirements to the generated gas toxicity. A further important requirement for any nitrogen-generating composition is that such performance properties as, for example, low initiating sensitivity to impact loads and friction, moisture and thermal resistance, charge strength, etc., must be provided for.

The prior art sodium azide-based pyrotechnic compositions for pure nitrogen generation are typically intended for passive restraint systems in vehicles. They feature short generation times, high pressures, and high combustion rates, resulting in toxic gas and sodium aerosol formation.

For example, U.S. Pat. No. 3,741,585 (published 26 Jun. 1973) discloses a nitrogen gas generating composition for use in emergency transport safety systems. The composition comprises: 60-70% of sodium azide, 30-40% of molybdenum disulfide, 1-20% of sulfur. Indicated that other possible metal azides and reactants are metallic oxides, metallic sulfides, metallic iodides, organic iodides, organic chlorides, and sulfur. Combustion of the experimental composition for about 40 ms. The combustion chamber pressure is 9-14 MPa (88-140 atm.). The generator outlet gas temperature is 111-463° C.

Patent U.S. Pat. No. 4,203,787 (published 20 May 1980) discloses a composition consisting of 60 to 80 wt. % alkali metal azide, 2 to 35 wt. % metal oxide selected from the group consisting of iron oxide, cobalt oxide, nickel oxide, palladium oxide, silicon oxide or mixtures thereof, 2 to 26 wt. % molybdenum disulfide and up to 6 wt. % sulfur. When combusted, the composition pressure is 14 MPa, while the generation time is less than 100 milliseconds.

The main flaw associated with the above compositions are: relatively low purity of the generated nitrogen (nitrogen content not more than 98 vol. %), the combustion product condensed phase sludge containing free sodium and the gaseous phase containing a substantial amount of impurities (0.3-1.5 g/m$^3$), i.e. toxic ammonia and sulfur dioxide, where sulfur is used, substantial amounts of residue and filter/cooler material particulates. Due to their porous structure, the prior art compositions are characterized by instability under the actions of vibration and impacts occurring during transportation and operation, and, as such, their main characteristics may not be reproduced. The above patents' materials do not provide such important information as the temperature conditions of operation, in particular, at below zero temperatures. Hydrogen release from the nozzle opening is unacceptable due to the fire and explosion hazards of combustion products when mixed with air.

Patent RU 2243959C1 (published 10 Jan. 2005) describes a composition for nitrogen producing, which composition comprises sodium azide, iron(III) oxide and titanium(IV) oxide. No judgement as to the actual performance of the composition when used in a generator can be made based on the presented testing results, since the tests were done in a manometric bomb at high pressures and temperatures. The main issues associated with the composition, such as low gas generation capacity (0.25 L/g at most), high porosity and low strength of the sludge, and high combustion rates result in the gas flow contamination with combustion products.

A binary composition for generating nitrogen gas is described in U.S. Pat. No. 3,895,098 (published 15 Jul. 1975). It comprises alkali metal azides, including lithium azide, sodium azide, and potassium azide, and metal oxides: copper oxide, iron oxide, tin oxide, titanium dioxide, lead oxide, chromium oxide, and zinc oxide. As an example, the composition comprises, in wt. %: 71% sodium azide $NaN_3$ and 29% iron(III) oxide $Fe_2O_3$, which is a stoichiometric ratio of the components. This prior art composition provides a rather high gas output (360 cm$^3$ from 1 g of the mixture). However, in real practice, sodium azide combustion in the presence of metal oxides is completely different from the sodium thermal reduction reactions calculated in the patent, so the composition combustion temperature is higher than the melting point of the main condensed products, resulting in the presence of vaporous or liquid free metallic sodium in the generated gases. Furthermore, the composition of U.S. Pat. No. 3,895,098 is intended for inflating vehicle air bags, rather than for fire extinguishing.

Patent RU 2542306 (published 20 Feb. 2015) describes a composition that may also be used for fire extinguishing purposes. The nitrogen-generating pyrotechnic composition comprises in wt. %: 85-91 of sodium azide, 1-3 of a copolymer of tetrafluorethylene and vinylidene fluoride as an oxidizing agent, and carbon as a framework formation agent. According to the inventors of RU 2542306, the technical result consists in increasing the pure cool nitrogen output through complete binding of metallic sodium and optimizing the ratio of the oxidizer/fuel thermal base components where the ratio is changed towards a fuel rich ratio. However, with the presence of organic components and carbon in the composition, the toxic gas content in combustion products is unacceptable. The patent materials do not provide any convincing proof of the free sodium absence in the residue or gaseous phase. According to patent RU 2542306, the nitrogen-generating composition is produced using a process customary in the industry, i.e. by mixing the components in an industrial mixer.

The formulation described in patent EP 2240403B1 (published 13 Feb. 2013) is intended for use in a fire-extinguishing generator. Nitrogen gas is generated from a solid material having a porosity of 20 to 75 vol. % and a composition comprising: 60 to 90 wt. % of sodium azide, 0.1 to 20 wt. % of an inert chemical coolant based on at least one inorganic salt, between 3 and 15 wt. % of modifying agent, for example, ferric oxide or sodium carbonate, and a binder, preferably fiberglass or a poly(tetrazole). Furthermore, the generator contains a coolant selected from LiF, NaF, KF, $Li_2O$, $Li_2C_2$, $Li_3N_3$, LiCl, NaCl, $CaF_2$, $Li_2SO_4$, $Li_2B_2O_4$, $Li_2B_4O_7$ and $Li_2SiO_3$, from which LiF is preferred. The poly(tetrazole) may be sodium poly(5-vinyltetrazole) or any tetrazole salt of alkali metal, such as potassium poly(5-vinyltetrazole) or similar poly(tetrazoles). The patent provides the combustion product analysis data in vol. %: Nitrogen>98; Hydrogen 0.7 (7000 ppm); Methane 0.017 (170 ppm); Carbon Monoxide 0,0001 (1 ppm); Ammonia 0.0113 (113 ppm); Water 0.22 (2200 ppm).

However, a porous charge is indicative of a high combustion rate and, therefore, of a high pressure within the housing. With the organic components present in the composition, the toxic gas content in combustion products will be high. Water, hydrogen and ammonia in a composition containing sodium azide substantially limit potential use of the composition due to safety requirements [Bagal, L. I., *Khimiya i tekhnologiya initsiiruyushchikh vzryvchatykh veshchestv*. Moscow, Mashinostroenie, 1975 (*Chemistry and Technology of Initiating Explosive Substances*, Moscow, Mashinostroenie, 1975).] Combustion product treatment by filtering at a high combustion rate and pressure does not preclude the presence of metallic sodium in the slag residue, which is another hazard associated with the generator operation and disposal.

The above disadvantages does not allow considering the claimed composition for use as a fire extinguishing medium due to its non-compliance with regulatory safety in use requirements.

A nitrogen-generating composition and a method for producing thereof which are closest to the present invention are disclosed in patent RU 2484075 (published 10 Jun. 2013), wherein the composition comprises binary mixtures of alkali metal azides, preferably sodium azide, metal oxides, preferably iron(III) oxide as an oxidizing agent and fuel, and moisture (water) as a wetting agent for the dry components in the amount not more than 0.3 wt. %. Furthermore, there is described a method for producing a pyrotechnic (nitrogen-generating) charge by staged mixing of sodium azide and iron oxide powders, followed by preparation of a process mix wetted with water, granule forming and drying the granules in a vacuum chamber to a moisture content of not more than 0.3 wt. %, the powder component mixing in a paddle-type mixer being done simultaneously with granule forming from the wetted process mix. Quantities of the components in the pyrotechnic binary composition suitable for the method of patent RU 2484075 were calculated based on a mathematical model for the design of the experiment which optimality were demonstrated by in-situ testing of a pilot lot of charges.

Thus, according to the inventors, the invention of patent RU 2484075 provides optimized sodium azide (59-65 wt. %) and iron oxide (35-41 wt. %) contents in the composition, thus ensuring efficient generation of nitrogen gas and formation, during the charge combustion, of strong porous slag residue structure entrapping the condensed phase to prevent it from entering the generated gas during the charge combustion and keeping its original shape. The patent further states that the technical result is accomplished by using sodium azide to iron oxide ratios optimized, based on the results of experimental studies, such that the nitrogen generation reaction follows the scheme $4NaN_3+Fe_2O_3 \rightarrow 2Na_2O.FeO+Fe+6N_2$ without metallic sodium formation.

However, the patent RU 2484075 invention specification does not provide reliable proof of the free sodium absence in or low toxicity of the combustion product gaseous phase, since the experiments were done with dummy specimens in a manometric bomb in high pressure conditions. The studies, however, demonstrated that the process of sodium azide combustion with iron oxide was actually complicated, done in a staged manner, with complex oxides as transition products decomposable to produce sodium iron dioxide and free sodium: $2Na_2O.FeO \rightarrow NaFeO_2+Na_2O+2Na$ (J. Chem. Soc (A), 1970, p. 1913-1916).

According to our own studies carried out using full-scale generators, which results are given in Examples 4 and 5 herein, the slag residues of the composition of patent RU2484075 were found to contain metallic sodium; the residues had a porous structure not conforming to the generator's inner contours, thus allowing the gaseous phase to break through. The slag's low strength is indicative of the absence of chemically bound oxides therein.

Certain difficulties associated with the process by which the composition of patent RU2484075 is produced are also due to the use of water for wetting the loose components, including sodium azide, as sodium azide, when exposed to a water medium, undergoes partial hydrolysis to form hydronitric acid with hazardous toxic properties, which rapidly evaporates from the solution into the environment. To neutralize this substance, special-purpose equipment and specific safety precautions are required (*Vrednye veshchestva v promyshlennosti. Spravochnik dlya khimikov, inzhenerov i vrachey*. Izd.7, t. III, L., Khimiya, 1977 (*Noxious Substances in Industry. A Reference Book for Chemists, Engineers and Physicians*. 7-th Edition, V. III, L., Khimiya, 1977)).

Metallic sodium present in the combustion product gaseous phase and the sintered mass (sludge) resulting from combustion of the prior art nitrogen-generating composition is due primarily to a suboptimal thermochemical system for free sodium binding, as well as to a high temperature and high pressure of saturated sodium vapors within the combustion chamber, high rate of the composition combustion and insufficient time during which the reactants are present in combustion zones until they are completely oxidized, along with a relatively low melting point of the condensed phase. Another factor contributing to the metallic sodium formation is fuel-rich pyrotechnic composition. All these result in the presence of vaporous or liquid free metallic sodium in the generated gases and the residue.

The primary cause of carbon monoxide and ammonia content in the combustion products is associated with incomplete combustion of the nitrogen-generating component (sodium azide) and its chemical purity, as well as the behavior of thermochemical reactions, which depends on both the nature of the composition components, in particular those of organic origin, and the combustion conditions, such as oxidizer insufficiency in the reaction zones, short time during which the fuel is present in the zones, formation of hard-burning carbonated layers on the composition surface, heat leakage to the environment.

SUMMARY OF THE INVENTION

An object of the present invention is to reduce free sodium and toxic substance contents in the products of combustion of a nitrogen-generating composition (NGC) for fire extinguishing not only in the NGC combustion zone downstream of the nitrogen generator nozzle exit (outlet), but also in the porous backbone remaining after the composition combustion, residue (sintered mass) acting as an additional filter for the fire-extinguishing composition combustion products, to maximum allowable concentrations by modifying the combustion processes through direct action on the chemical components' interfacial interactions both in the fuel oxidation reaction zone in the condensed phase, and in the region where gaseous phase reactions and catalytic processes occur in a cooler unit which is part of a nitrogen generator for fire extinguishing.

The above object is accomplished by providing a nitrogen-generating composition for fire extinguishing, comprising: alkali metal azide, heavy metal oxide as an oxidizing agent and fuel, and a wetting agent for the dry components, wherein the composition according to the invention further comprises a combustion modifier in the form of aluminium oxide modified with cobalt(II) nitrate ($Co(NO_3)_2$), nickel oxide and copper oxide as promoting additives, and carboxylic acid ester as the wetting agent, the mixing ratio in wt. % being as follows:

| | |
|---|---|
| heavy metal oxide | 25.0-45.0 |
| combustion modifier | 12.0-18.0 |
| alkali metal azide | balance to 100 |
| wetting agent (residue after drying) | 0.07-2.0 above 100%. |

More particularly, the composition of the present invention comprises components at the following mixing ratio in wt. %:

| | |
|---|---|
| heavy metal oxide | 25.0-45.0 |
| cobalt nitrate | 1.0-2.0 |
| aluminium oxide | 10.0-16.0 |
| copper oxide | 0.1-0.2 |
| nickel oxide | 0.2-0.3 |
| alkali metal azide | balance to 100 |
| wetting agent (residue after drying) | 0.07-2.0 above 100%. |

The composition comprises, for example, iron(III) oxide, or titanium(IV) oxide, or molybdenum(VI) oxide, or a mixture thereof in any combination, preferably iron(III) oxide, as the heavy metal; sodium azide, or potassium azide, or a mixture thereof in any combination, preferably sodium azide, as the alkali metal azide; and carboxylic acid ester, in particular ethyl acetate or butyl acetate, as the wetting agent.

Furthermore, the above object is accomplished by providing a method for producing a nitrogen-generating composition for fire extinguishing, the method comprising: mixing, in a staged manner, alkali metal azide, heavy metal oxide as an oxidizing agent and fuel, and a wetting agent for dry components, followed by granule forming, wherein, according to the invention, a combustion modifier in the form of aluminium oxide modified with cobalt(II) nitrate ($Co(NO_3)_2$) is further added, with nickel oxide and copper oxide as accelerating additives, and carboxylic acid ester is used as the wetting agent, to which end Stage 1 includes: preparing aluminium oxide modified with cobalt(II) nitrate ($Co(NO_3)_2$), aluminium oxide being mixed with the cobalt nitrate and the wetting agent, allowing to stand and drying to produce a 1st mixture of uniform color; Stage 2 includes: mixing the 1st mixture with heavy metal oxide and said wetting agent until a 2nd mixture is produced; Stage 3 includes: mixing alkali metal azide in the form of powder with said wetting agent until a 3rd mixture with a viscosity sufficient for subsequent mixing thereof with other components of the composition is produced; Stage 4 includes: mixing the mixtures produced at Stages 2 and 3, and, simultaneously, with copper oxide, drying the mass thereby produced to remove, as much as possible, any residue of the wetting agent, typically to a moisture content of 0.07-2%, and forming granules.

The granules are then formed into pellets of a shape, density and sizes such as to have effect on the composition combustion kinetics, which, in combination with the fire-extinguishing generator design and internal ballistics parameters, provide complete combustion of the reactants when in active zones and the time for gas generation.

In one particular implementation, the pellets are formed to have a shape of a cylinder with a passage and with an outer to inner diameter ratio from 5 to 7.

The method is implemented by: using, for example, sodium azide or potassium azide or a mixture thereof in any combination, preferably sodium azide, as the alkali metal azide; using, for example, iron(III) oxide, or titanium(IV) oxide, or molybdenum(VI) oxide, or a mixture thereof in any combination, preferably iron(III) oxide, as the heavy metal oxide and, in particular, using ethyl acetate or butyl acetate as the carboxylic acid ester.

In one particular specific implementation, mixing of aluminium oxide with cobalt nitrate and the wetting agent were done during at least 20 minutes until a uniformly colored mass was produced, which was allowed to stand during about 3 hours and dried at a temperature of about 80 C° to produce a 1st mixture of uniform color, mixing of the components at Stage 2 was done during at least 15 minutes such as to produce a mixture also of uniform color, and drying of the mass produced at Stage 4 was done at a temperature of about 80 C° during at least 2 hours to achieve a residual moisture content in the composition of at most 2% of the dry components' weight.

The essence of the invention is that free sodium and sodium oxide contents are precluded in both the combustion products and the sintered mass (residue) by including an ancillary reactant, i.e. a combustion modifier, in the form of aluminium oxide modified with cobalt(II) nitrate ($Co(NO_3)_2$), with nickel oxide and copper oxide as accelerating additives, thus, in the inventors' opinion, changing the combustion process thermodynamics and kinetics and enabling reduction of the metallic sodium content in combustion zones due to sodium iron(III) oxide and sodium aluminate formation, which chemically bind sodium and, by interacting with each other by virtue of, inter alia, isomorphism of their properties, produce a continuous series of solid solutions, i.e. sodium aluminaferrites, providing, as result, a hard-melting solid product with a melting point equal to or higher than 1350° C., while the efficient reduction in the toxic gas concentration is achieved by intensifying their direct oxidation processes through a combination of cobalt(II) nitrate with accelerating additives, i.e. aluminium, copper and nickel oxides, both directly in the reaction zone and the region where the fire-extinguishing aerosol generator cooler is located. The inventors hereof believe that the wetting agent, i.e. carboxylic acid esters, while providing the wetting action, also enhances the surface absorption of the metal oxides to the alkali metal azides.

The technical result accomplished by the present invention is precluding free sodium content in the gaseous phase and metallic sodium content in the combustion product sintered mass (sludge); reducing toxic gas concentration downstream of the fire-extinguishing generator nozzle exit; reducing the combustion chamber pressure and the gas jet temperature; increasing the generator's gas generation capacity, and, thereby improving the operational safety and fire-extinguishing efficiency.

BRIEF DESCRIPTION OF THE FIGURES

The invention may be better understood with reference to the accompanying figures and specific examples of producing the nitrogen-generating (nitrogen generant) composition for fire-extinguishing in accordance with the present invention.

List of figures, where.

DETAILED DESCRIPTION OF EXAMPLE EMBODIMENTS

Figure 1:
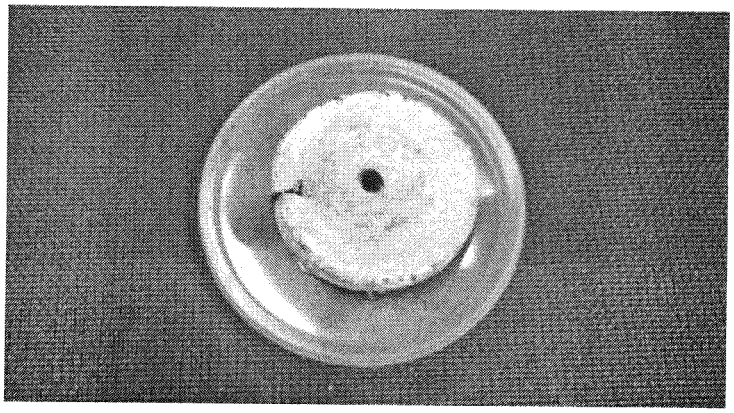
FIG. 1 shows a photograph of condensed residue of the products of combustion of the claimed composition produced in Example 1 herein.

The composition of the present invention is produced using:

sodium azide (CAS 26628-22-8), potassium azide (CAS 20762-60-1) as the nitrogen containing substance;

iron(III) oxide (CAS1309-37-1), or titanium(IV) dioxide (CAS13463-67-7), or molybdenum(VI) oxide (CAS1313-27-5) as the oxidizing agent and fuel;

cobalt(II) nitrate ($Co(NO_3)_2$) (CAS 10026-22-9) as a modifier; aluminium oxide ($Al_2O_3$) (CAS 1344-28-1) also as a modifier;

copper oxide (CuO) (CAS 1317-38-0) as a promoting additive;

nickel oxide NiO (CAS 1313-99-1) as a combustion catalyst;

ethyl acetate or butyl acetate as a process additive, i.e. a wetting agent for mixing the dry components.

The nitrogen-generating (nitrogen generant) composition of the present invention for fire extinguishing is produced as follows:

Stage 1: aluminium oxide modified with cobalt(II) nitrate ($Co(NO)_3)_2$) is prepared, to which end cobalt nitrate $Co(NO_3)_2$ and aluminium oxide $Al_2O_3$ are mixed and ethyl acetate is added, followed by allowing to stand and drying to produce a mixture of uniform color (a 1st mixture), thus providing for aluminium oxide surface absorption by cobalt nitrate. In a particular embodiment, the mixture was agitated during about 20 minutes and then allowed to stand during about 3 hours and dried at a temperature of about 80° C. to remove the wetting agent.

Stage 2: mixing modified aluminium oxide with iron oxide, or titanium oxide, or molybdenum oxide, adding ethyl acetate, which mixture is agitated until a uniform color is achieved (a 2nd mixture). In a particular embodiment, the mixture was agitated during about 15 minutes.

Stage 3: sodium azide is mixed with a wetting agent, i.e. butyl acetate or ethyl acetate, until a viscosity is achieved which is sufficient for subsequent mixing this mixture (a 3rd mixture) with other components of the composition. In a particular embodiment, sodium azide was used in the form of powder and mixed with the wetting agent used in an amount of about 10% of the sodium azide weight during about 15 minutes at a temperature of about 30° C., until a 3rd mixture with a viscosity sufficient for subsequent mixing thereof with other components of the composition is produced.

Stage 4: in a mixer, the mass produced at Stage 2 is mixed with the sodium azide mass produced at Stage 3 and, simultaneously, with copper oxide; the mixing time is 30-40 minutes.

Stage 5: the mass produced at Stage 4 is dried at a temperature enabling removal of residual solvent to produce the claimed composition.

To use the composition of the present invention in a nitrogen generator (a fire-extinguishing generator), the composition is shaped, densified and sized such as to meet the fire-extinguishing generator's thermodynamic, internal ballistics and gas dynamics parameters and its operational requirements.

To this end, at Stage 6, the mass produced at Stage 5 is formed into granules, for example, by passing the mass through a sieve with a specified mesh size, for example, 1.5-3.0 mm.

Stage 7: articles are formed, for example, by compressing the granules into pellets of specified shape, density and strength contributing to the provision of required operating characteristics and affecting thermodynamic and gas dynamics parameters in the respective fire-extinguishing generator combustion chamber.

The tests were done in a generator designed such as to allow using nitrogen-generating pellets in an amount of up to 1000 g and provided with a cooler unit with a cooler loaded into it, such as, in particular, sphere-shaped elements 5-7 mm in diameter made of CB-6 grade aluminium oxide (manufactured by ZiboZhengsenChemicalCo., Ltd), quartz sand (mesh fraction 10-12 (1-2 mm)), or, alternatively, round steel granules 2.5 mm in diameter in the amount of about 900 g.

In the course of the tests, temperature and pressure were measured in the generator housing and the cubicle, records were taken of the nitrogen, oxygen, carbon dioxide and ammonia concentrations in the cubicle atmosphere, and video recording of the generator operation process was carried out. The pellet density was measured and its form was recorded both before and after testing.

Free sodium content in the combustion product residue (sintered mass) was determined by injecting water into the generator housing upon completion of a test and by assessing the quantity of released hydrogen.

Example 1. The nitrogen-generating (nitrogen generant) composition of the present invention was produced by using 450 g of sodium azide, 315 g of iron oxide, 117 g of aluminium oxide, 14 g of cobalt nitrate, 1.8 g of copper oxide, 1.8 g of nickel oxide, 90 g of ethyl acetate (not included in the balance of composition weight). The total weight of the composition's dry components was 899.6 g. Said components in said quantities were mixed as follows:

First (Stage 1), cobalt nitrate $Co(NO_3)_2$ was mixed with aluminium oxide $Al_2O_3$ during 20 minutes, adding ethyl acetate, until a mixture of uniform color was produced (a 1st mixture), followed by allowing to stand for 3 hours and drying at the temperature of 80° C.

Then (Stage 2), modified aluminium oxide ($1^{st}$ mixture) was mixed during 15 minutes with iron oxide, adding ethyl acetate, until a mixture of uniform color was produced (a 2nd mixture).

Separately (Stage 3), sodium azide was prepared in a mixer, to which end sodium azide powder was mixed during 15 minutes at the temperature of 30° C. with 10 g of ethyl acetate until a viscosity sufficient for mixing this mixture (a 3rd mixture) with other components was achieved.

Following that (at Stage 4), the mass produced at Stage 2 was mixed during 20 minutes in a mixer with the sodium azide mass produced at Stage 3 and, simultaneously, with copper and nickel oxides.

Then (Stage 5), the mass produced at Stage 4 was dried at the temperature of 80° C. during 2.5 hours until a residual moisture content in the composition of at most 2 wt. % was achieved, such as to remove wetting agent residues, thus producing the claimed composition. Further (Stage 6), the mass produced at Stage 5 was formed into granules by passing the mass through a mesh size 8 (2.4 mm) sieve. Finally, a mass with the weight of 902 g was produced. Therefore, the residual wetting agent content in the composition was 2.4 g, which amounts to ~0.27% in addition to the main composition.

Further (Stage 7), pellets were formed by compressing the granules to produce articles of 80 mm in diameter, having a 10-mm passage and the weight of 225 g, at the specific compressing pressure of 700 kg/cm$^2$.

Combustion products of the nitrogen-generating composition of the present invention were analyzed for toxic gas content, such as carbon oxide CO and ammonia NH3, in FP-500S type fire-extinguishing generators (http://www.firepro.hu/en/products/small-to-medium-units/fp-500s). The generator cooler unit contained 750 g of aluminium oxide granules.

The tests were done on a test bench in a cubicle with a volume of about 1 m$^3$. Toxic gas concentrations were measured with a Drager Tubes measurement system gas detector, an Accuro pump, and detection tubes 0.3% B (CH 29901) for carbon dioxide and 5/a (CH 20501) for ammonia. Oxygen, carbon dioxide and ammonia concentrations were analyzed with a Drager X-am 7000 instrument using the following sensors: CATEX (catalytic) and EC (electrochemical). Nitrogen concentration was measured with a Teledyne 3000 instrument based on an R-33N sensor. Free sodium content in the combustion product residue was determined by injecting water into the generator housing upon completion of a test and by assessing the quantity of released hydrogen.

Pellet density of 2.55 g/cm$^3$ and its combustion rate of 1.4 mm/s at atmospheric conditions were determined.

The data obtained from the tests are given under Item 1 in the TABLE showing the toxic gas and free sodium concentrations measured in the nitrogen-generating compositions' combustion products.

The analysis indicated that there was no free metallic sodium in the combustion product residue (sintered mass) which fully, without any deformation, retained the shape of the generator housing inner cavity (FIG. 1). The toxic gas concentration was substantially below the maximum allowable values.

Example 2. The nitrogen-generating composition of the present invention was produced by using 504 g of sodium azide, 270 g of titanium oxide, 108 g of aluminium oxide, 13.5 g of cobalt nitrate, 1.8 g of copper oxide, 2.7 g of nickel oxide. Butyl acetate in the amount of 90 g was used as the wetting agent. Said components were mixed following the same sequence as described in Example 1, except for Stage 2, wherein modified aluminium oxide was mixed with titanium oxide. Finally, a mass was produced having the weight of 905 g, with the residual wetting agent content in the composition of 5 g, which is ~0.56% in addition to the main composition weight. Toxic gas content resulting from combustion of the claimed composition was analyzed as described in Example 1. The obtained data is given in the TABLE under Item 2. No free sodium was detected in the generator housing; the combustion product residue retains the inner shape of the generator housing. The gas toxicity is substantially below the allowable standard values.

Example 3. The nitrogen-generating composition of the present invention was produced by using 520 g of sodium azide, 260 g of molybdenum oxide, 103 g of aluminium oxide, 11 g of cobalt nitrate, 1 g of copper oxide, 2 g of nickel oxide; said components in said quantities were mixed in a staged manner and produced following the same sequence as described in Example 1, except for Stage 2, wherein modified aluminium oxide was mixed with molybdenum oxide. Finally, a mass was produced having the weight of 910 g, with the residual wetting agent content in the composition of 13 g, which is ~1.45% in addition to the main composition weight. Free sodium and toxic gas contents resulting from combustion of the claimed composition were analyzed as described in Example 1. The obtained data is given in the TABLE under Item 3. There was no free sodium; the combustion product residue retains the inner shape of the generator housing.

Below are examples of further studies of the free sodium and toxic gas contents resulting from combustion of the prior art and experimental nitrogen-generating compositions. The studies were carried out in the same conditions as described in Example 1.

Example 4. The composition was produced in accordance with the process described in patent RU 2484075.

The nitrogen-generating composition was produced by using 540 g of sodium azide, 360 g of iron oxide, loading them into a planetary mixer, and wetting the composition with water. The components were mixed following the sequence described in patent RU 2484075, except for the granule forming stage, wherein the composition was loaded out onto a 14 mesh mechanical sieve with a screen aperture size of 1.5×1.5 mm and passed through the screen into a vessel to produce the granules. Iron(III) oxide powder for ferrites was used in said amount, which, prior to mixing, was sieved through a 028 (25) screen, while the sodium azide powder was used in the as-delivered condition.

The composition components were mixed during 10 minutes in a 35CB mixer with the maximum load of 13 kg.

Then water was added in the amount of 8 wt. % in addition to 100% of the dry components mixture and mixing was done during 15 minutes, followed by blowing air heated to 50° C. into the mixer at the pressure of 0.3 MPa (3 kgf/cm$^2$) and further mixing of the wetted composition during 25 minutes. The wetted composition was loaded out onto a 14 mesh sieve with a screen aperture size of 1.5×1.5 mm and passed through the screen into a vessel to produce the granules. The produced granules were placed on pallets in a 3-cm layer. The pallets were placed on racks at the temperature of 40° C. for 40 minutes and then allowed to stand for further 5 hours at the temperature of 60° C. with automatic agitation. Finally, a mass was produced having the weight of 901r. Water content was 0.11 wt. %.

Then, compressing was done to produce articles of 80 mm in diameter, with a 30-mm passage and the weight of 225 g, at the specific compressing pressure of 700 kg/cm$^2$, as described at Stage 7 in Example 1. The generator cooler unit contained 1300 g of aluminium oxide.

Toxic gas content resulting from combustion of the claimed composition was analyzed as described in Example 1. Pellet density was 1.67 g/cm$^3$; combustion rate at atmospheric conditions was 1.75 mm/s.

The obtained data is given in the TABLE under Item 4.

Figure 2:
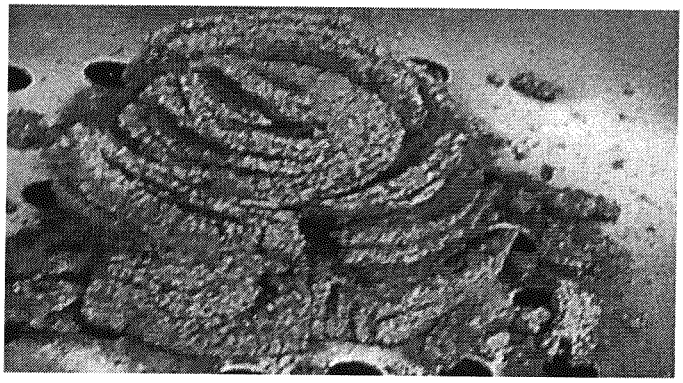
FIG. 2 shows a photograph of condensed residue of the products of combustion of the composition produced in accordance with prior art (patent RU2484075), ref. to Example 4 herein.

Both in the generator housing and in the residue, a substantial quantity of free metallic sodium was detected; the slag residue structure was loose, amorphous, with its sizes substantially changed with respected to the housing inner diameter (FIG. 2).

Example 5. The nitrogen-generating (nitrogen generant) composition was produced by using 540 g of sodium azide, 360 g of iron oxide; the dry components were wetted with water. Said components were mixed in a staged manner following the sequence as described in Example 4.

Finally, a mass was produced having the weight of 901 g. Water content was 0.11 wt. %.

Then, compressing was done to produce articles of 80 mm in diameter, with a 30-mm passage and the weight of 225 g, at the specific compressing pressure of 700 kg/cm$^2$, as described at Stage 7 in Example 1. Toxic gas content resulting from combustion of the claimed composition was analyzed as described in Example 1, except that the generator cooler unit contained 900 g of steel granules and 400 g of quartz sand.

The obtained data is given in the TABLE under Item 5.

Both in the generator housing and in the residue, a substantial quantity of free metallic sodium was detected; the slag residue structure was loose, amorphous, with its sizes substantially changed with respected to the housing inner diameter.

Example 6. The nitrogen-generating composition of the present invention was produced by using 440 g of potassium azide, 325 g of iron(III) oxide, 120 g of aluminium oxide, 15.0 g of cobalt nitrate, 1.8 g of copper oxide, 1.9 g of nickel oxide. Butyl acetate in the amount of 90 g was used as the wetting agent. Said components were mixed following the same sequence as described in Example 1, except for Stage 3, wherein potassium azide was prepared in a mixer, to which end potassium azide powder was mixed during 15 minutes at the temperature of 20° C. with 10 g of butyl acetate until a viscosity sufficient for subsequent mixing thereof with other components was achieved (a 3rd mixture). At Stage 4, the mass produced at Stage 2 was mixed, in a mixer, with the potassium azide mass produced at Stage 3 and, simultaneously, with copper and nickel oxides during 20 minutes. Finally, a mass was produced having the weight of 905 g with the residual butyl acetate content of 0.14 wt. %. The operations at the next stages were the same as those described in Example 1. Toxic gas content resulting from combustion of the claimed composition was analyzed as described in Example 1. The obtained data is given in the TABLE under Item 6. No free sodium was detected in the generator housing; the combustion product residue retains the inner shape of the generator housing. The gas toxicity is substantially below the allowable standard values.

Combustion products of the nitrogen-generating compositions under Items 7 to 14 in the TABLE were analyzed for toxic gas and free sodium contents. The compositions were produced as described in Example 1, with ethyl acetate or butyl acetate used as the wetting agent as shown in the TABLE. Residual wetting agent content in addition to the main composition weight was as follows: in Composition No. 7-0.2 wt. %; in Composition No. 8-0.18 wt. %; in Composition No. 9-0.17 wt. %; in Composition No. 10-0.21 wt. %; in Composition No. 11-0.14 wt. %; in Composition No. 12-0.14 wt. %; in Composition No. 13-0.3 wt. %; in Composition No. 14-0.26 wt. %. Toxic gas content resulting from combustion of these compositions was analyzed as described in Example 1. The results are shown in the TABLE under Items 7 to 14. In respect of these compositions, it was also found that: no free sodium was detected in the generator housing; the combustion product residue retains the inner shape of the generator housing. The gas toxicity is substantially below the allowable standard values.

INDUSTRIAL APPLICABILITY

The above examples of specific implementations demonstrate that the method for producing a nitrogen-generating composition of the present invention for fire extinguishing may be put into practice in accordance with the specification. The above examples demonstrate the feasibility of the claimed result, i.e. precluding the content of metallic sodium, either in the form of aerosol, or in the condensed phase (residue) of the combustion products, and reducing the ammonia and CO contents in the pure nitrogen jet downstream of the fire-extinguishing generator nozzle exit (outlet opening). The inventors herein accomplish the results of precluding the free sodium content and efficient reduction in the toxic gas concentration through using an ancillary reactant, i.e. aluminium oxide modified with cobalt(II) nitrate, thus changing the combustion process kinetics and reducing the metallic sodium content in combustion zones due to sodium iron(III) oxide and sodium aluminate formation, which chemically bind sodium and, by interacting with each other, produce, as a result, a hard-melting solid product devoid of free metallic sodium and having a melting point equal to or higher than 1350° C., while the efficient reduction in the toxic gas concentration is achieved by intensifying their direct oxidation processes through a combination of cobalt(II) nitrate with accelerating additives, i.e. aluminium, copper and nickel oxides, both directly in the nitrogen-generating composition combustion reaction zone and the region where the fire-extinguishing generator cooler is located.

Accomplishment of the technical result is evidenced by the photograph (FIG. 2) showing the condensed residues of combustion products of the prior art (RU2484075) composition, wherein water was used as the wetting agent, and those of the claimed composition produced according to Example 1 herein (FIG. 1). The difference is obvious: the photograph of FIG. 1 shows a solid structure resembling a real clinker, while the photograph of FIG. 2 shows a decomposed structure of the residue.

TABLE

Measured Data on the Toxic Gas and Free Sodium Contents in Nitrogen-Generating Composition Combustion Products Cooler: $Al_2O_3$ granules, except for Composition No. 5, where steel grits + quartz sand were used. Symbols in the TABLE: W—Residual Wetting Agent (0.14 . . . 1.42 wt. %): EA—Ethyl Acetate, BA—Butyl Acetate; t—Nitrogen Generation Time; N—Gas Generation Efficiency; P—Generator Pressure.

| Test | Nitrogen-Generating Composition Components (wt. %) | | | | | | | | | | | Toxic Components in Combustion Products | | | Parameters | |
|---|---|---|---|---|---|---|---|---|---|---|---|---|---|---|---|---|
| | | | | | | | | | | | | CO | $NH_3$ | P | | |
| No. | $NaN_3$ | $Fe_2O_3$ | $TiO_2$ | $MoO_3$ | $Al_2O_3$ | CuO | NiO | $Co(NO_3)_2$ | $KN_3$ | W | Na | (ppm) | (ppm) | (atm) | t (s) | N (%) |
| 1 | 2 | 3 | 4 | 5 | 6 | 7 | 8 | 9 | 10 | 11 | 13 | 14 | 15 | 16 | 17 | 18 |
| 1 | 50 | 35 | | | 13 | 0.2 | 0.2 | 1.6 | | EA | no | 150 | 10 | 2 | 10 | 40 |
| 2 | 56 | | 30 | | 12 | 0.2 | 0.3 | 1.5 | | BA | no | 230 | 12 | 3 | 9 | 39 |
| 3 | 58 | | | 29 | 11.5 | 0.1 | 0.2 | 1.2 | | EA | no | 208 | 15 | 2.5 | 11 | 36 |
| 4 | 60 | 40 | | | | | | | | water | yes | 845 | 21 | 5 | 5 | 40 |
| 5 | 60 | 40 | | | | | | | | water | yes | 765 | 18 | 7 | 5 | 39 |
| 6 | | 36 | | | 13 | 0.2 | 0.2 | 1.6 | 49 | BA | no | 210 | 13 | 3 | 8 | 40 |
| 7 | 43 | 45 | | | 10 | 0.2 | 0.3 | 1.5 | | EA | no | 180 | 17 | 2 | 9 | 38 |
| 8 | 57 | 25 | | | 16 | 0.2 | 0.3 | 1.5 | | BA | no | 230 | 15 | 3 | 8 | 39 |
| 9 | 50 | 35 | | | 13 | 0.1 | 0.2 | 1.7 | | EA | no | 120 | 15 | 2.5 | 7 | 40 |
| 10 | 50 | 32 | | | 16 | 0.2 | 0.2 | 1.6 | | EA | no | 110 | 13 | 2.3 | 7 | 40 |
| 11 | 52 | 30 | | | 15.6 | 0.2 | 0.2 | 2 | | EA | no | 115 | 12 | 2.4 | 7 | 40 |
| 12 | 49 | 33 | | | 15.5 | 0.2 | 0.3 | 2 | | BA | no | 175 | 16 | 2 | 9 | 40 |
| 13 | 50 | 34 | | | 14.6 | 0.2 | 0.2 | 1 | | EA | no | 110 | 13 | 2.1 | 9 | 39 |
| 14 | 53 | 35 | | | 9.5 | 0.2 | 0.3 | 2 | | EA | no | 119 | 15 | 2.5 | 8 | 40 |
| * Toxic gas concentrations immediately dangerous to life (ppm) | | | | | | | | | | | | 3000 | 5000 | | | |

* Vrednye veshchestva v promyshlennosti. Spravochnik dlya khimikov, inzhenerov i vrachey. Tom III. Neorganicheskiye i elementoorganicheskiye soedineniya. (*Noxious Substances in Industry. A Reference Book for Chemists, Engineers and Physicians. Volume III. Non-organic and Organoelemental Compounds*), Leningrad, "Khimiya" 1997 https://de.wikipedia.org/wiki/Ammoniak

The invention claimed is:

1. A nitrogen-generating composition for fire extinguishing, comprising: alkali metal azide, heavy metal oxide as an oxidizing agent and fuel, wherein the composition further comprises a combustion modifier in the form of aluminium oxide modified with cobalt (II) nitrate ($Co(NO_3)_2$), nickel oxide and copper oxide as promoting additives, the mixing ratio in wt. % being as follows:

| | |
|---|---|
| heavy metal oxide | 25.0-45.0, |
| cobalt nitrate | 1.0-2.0, |
| aluminium oxide | 10.0-16.0, |
| copper oxide | 0.1-0.2, |
| nickel oxide | 0.2-0.3, |
| alkali metal azide | balance to 100. |

2. The nitrogen-generating composition of claim 1, wherein the heavy metal oxide is iron(III) oxide or titanium (IV) oxide or molybdenum(VI) oxide or a mixture thereof in any combination.

3. The nitrogen-generating composition of claim 1, wherein the alkali metal azide is sodium azide or potassium azide or a mixture thereof in any combination.

4. A method for producing the nitrogen-generating composition of claim 1, comprising:

mixing the aluminium oxide with the cobalt(II) nitrate ($Co(NO_3)_2$) and a wetting agent, allowing to stand and dry to produce a first mixture of uniform color;

mixing the first mixture with the heavy metal oxide and the wetting agent until a second mixture of uniform color is produced;

mixing the alkali metal azide with the wetting agent until a third mixture is produced;

mixing the second and third mixtures with the copper oxide and the nickel oxide and drying to produce a resulting mass; and, forming granules from the resulting mass.

5. The method of claim 4, wherein the granules are formed into tablets.

6. The method of claim 4, wherein the wetting agent is ethyl acetate or butyl acetate.

7. The method of claim 4, wherein the alkali metal azide is sodium azide or potassium azide or a mixture thereof in any combination.

8. The method of claim 4, wherein the heavy metal oxide is iron(III) oxide, or titanium(IV) oxide, or molybdenum(VI) oxide or a mixture thereof in any combination.

9. The method of claim 5, wherein the tablets are formed to have a shape of a cylinder with a passage and with an outer to inner diameter ratio from 5 to 7.

* * * * *